US006990384B2

(12) United States Patent
Miller et al.

(10) Patent No.: US 6,990,384 B2
(45) **Date of Patent: *Jan. 24, 2006**

(54) TRUSS PLATE DETECTOR

(75) Inventors: Donald Miller, Portland, OR (US); Chris Lambert, Essexville, MI (US)

(73) Assignee: Laharco, Inc., Portland, OR (US)

( * ) Notice: Subject to any disclaimer, the term of this patent is extended or adjusted under 35 U.S.C. 154(b) by 105 days.

This patent is subject to a terminal disclaimer.

(21) Appl. No.: 10/268,032

(22) Filed: Oct. 8, 2002

(65) Prior Publication Data

US 2003/0088331 A1 May 8, 2003

Related U.S. Application Data

(60) Provisional application No. 60/328,255, filed on Oct. 9, 2001.

(51) Int. Cl.
*G06F 19/00* (2006.01)

(52) U.S. Cl. ..... 700/110; 700/108; 382/141; 73/35.07

(58) Field of Classification Search ..... 700/108–110, 700/90; 382/141; 702/182–185; 73/35.07; 100/35, 913; 52/696, 633
See application file for complete search history.

(56) References Cited

U.S. PATENT DOCUMENTS

| | | | | |
|---|---|---|---|---|
| 2,934,698 A | | 4/1960 | Longland et al. | |
| 3,430,221 A | | 2/1969 | Barringer et al. | |
| 3,857,020 A | | 12/1974 | Higginbotham et al. | |
| 4,096,437 A | | 6/1978 | Kitzinger et al. | |
| 4,488,113 A | | 12/1984 | Heemstra | |
| 4,514,899 A | | 5/1985 | Burger | |
| 4,945,492 A | | 7/1990 | Bennett | |
| 4,965,740 A | | 10/1990 | Schofield et al. | |
| 5,063,347 A | | 11/1991 | Shigeno et al. | |
| 5,264,733 A | | 11/1993 | Tigges | |
| 5,440,977 A | | 8/1995 | Poutanen | |
| 5,506,914 A | | 4/1996 | Baker | |
| 5,617,025 A | | 4/1997 | Taylor et al. | |
| 5,640,832 A | * | 6/1997 | Black, Jr. | 53/442 |
| 5,646,859 A | | 7/1997 | Petta et al. | |
| 5,831,431 A | | 11/1998 | Gottfried-Gottfried et al. | |
| 5,929,765 A | | 7/1999 | Urech et al. | |
| 6,100,810 A | | 8/2000 | Koorsen | |
| 6,468,024 B2 | * | 10/2002 | Bishop et al. | 414/788.3 |

* cited by examiner

*Primary Examiner*—Jayprakash N. Gandhi
(74) *Attorney, Agent, or Firm*—Marger Johnson & McCollom, P.C.

(57) ABSTRACT

A truss plate detector preferably includes a first sensor array and a second sensor array. The first sensor array includes a plurality of sensors arranged to detect truss plates on a first side of a truss. A second sensor array preferably includes a plurality of sensors arranged to detect truss plates on a second side of a truss. A circuit is configured to receive signals from the first and second sensor arrays and to notify a user when one or more truss plates are missing or misaligned. For instance, the sensors in the first and second sensor arrays are preferably arranged opposite each other along the arrays. The truss plate detector can then be configured to notify a user when a sensor in the first sensor array detects a truss plate but neither a corresponding sensor nor an adjacent sensor in the second sensor array detects a truss plate. By providing a plurality of sensors in each array, the truss plate detector is capable of detecting a lateral position of truss plates on a truss being fed through the truss plate detector.

20 Claims, 20 Drawing Sheets

Plate Detector Block Diagram

Plate Detector Block Diagram

TRUSS PLATE DETECTOR

This application is a continuation-in-part of, and claims priority from, U.S. Provisional Application Ser. No. 60/328,255 filed Oct. 9, 2000, the contents of which are incorporated herein by reference in their entirety.

BACKGROUND OF THE INVENTION

1. Field of the Invention

The present invention relates to an apparatus for detecting truss plates. More specifically, this invention relates to a detector that identifies missing or misaligned truss plates during the truss assembly process.

2. Background Art

One of the most problematic and recurring quality control issues in a truss mill is that of missing truss (e.g., nail) plates on finished products. The issue exists in nearly all truss mills, whether they are building custom trusses for an expensive home, or simply building the same stock trusses for local lumber yards for days at a time. This problem is common throughout the industry and can be expensive to resolve.

During the truss assembly process, builders tap nail plates into place on the top of each lumber component intersection (joint). The builder then pries up the truss to place a companion plate in the same position on the back side. A roller gantry moves down the line and forces each plate partially into the lumber. The truss is then moved off to a final exit roller (press) which is generally set to an exact 1.5" span. The exit roller presses with enough force to embed the nail plates into the truss and provide the strength that the truss was engineered to have. The truss is then moved down a line and stacked up with other trusses in a job. When the job stack is complete, it is banded together and placed on a truck to be delivered to the customer (e.g., a building contractor).

Unfortunately, however, the roller gantry system requires two elements for ideal operation. The first requirement is an attentive builder. If a builder is not fully attentive, or is rushing through production to meet quotas, it is very easy to miss positioning a nail plate, particularly on the bottom side of the truss. Omitting nail plates on the bottom of the truss is a common mistake. The builder must also remain attentive after the truss is complete and is being pressed by the exit rollers. If a truss is missing a nail plate, the builder should catch the error before the truss is stacked with the other trusses. If the builder fails to notice the missing plate, the error will likely not be caught until the truss has already been shipped to the job site.

The second important element for ideal operation of the roller gantry is mechanical accuracy of the equipment. If gantry tables are misaligned or out of level, the rolling press action that embeds the nail plates partially into the lumber can be inefficient. As a result, when the truss is popped up to be sent through the exit roller, nail plates may only be loosely connected on a back side of the truss or may not be connected at all. Another problem can be improperly operating conveyance rollers that are used to move the truss to the exit rollers. Bad or damaged rollers can catch poorly embedded nail plates and cause them to fall off or be peeled back and folded up prior to reaching the exit roller press. Either error results in a truss that cannot meet the engineered joint strengths.

Generally, when a truss leaves the mill without proper plating, it is the contractor or end customer that finds the defect and reports it to the truss mill management. Since the improperly plated truss does not meet the required engineering standards for the truss design, it is the truss mill's responsibility to remedy the situation. This can be done by sending a mill employee to the job site with the required nail plate(s) and some special field equipment that allows the employee to press the plate into the lumber with the necessary pressure. The other solution would be to set up and build an entirely new truss to be delivered to the job site. Neither of these solutions are desirable, however, particularly considering that most truss mills deliver their products within a radius of about 100 miles, and sometimes up to 200 miles or more.

The time and expense of sending a replacement truss, or an agent and equipment to repair the truss, can be quite substantial, eating into the truss mill's profit. In addition, negative public relations can result, particularly if the contractor is delayed substantially while waiting for the truss to be repaired, or if missing nail plate mistakes happen frequently. Contractors and customers view this problem as a serious lack of quality control and may consider looking to other sources to fulfill their future truss requirements.

The industry would be benefited by a method and apparatus for monitoring trusses during the production process to detect missing plates before they are placed in a stack and shipped off to a job site. The industry would also benefit from a method and apparatus that can detect misaligned nail plates.

SUMMARY OF THE INVENTION

The principles of the present invention enable a truss plate detector that can detect missing or misaligned truss plates during a truss assembly process. The truss plate detector is preferably reliable, easy to use, and easy to maintain. The truss plate detector can further be configured to use inexpensive and readily replaceable sensor arrays to lower manufacturing and maintenance costs.

A truss plate detector preferably includes a first sensor array having a plurality of sensors arranged in a line to detect truss plates on a first side of a truss. A second sensor array includes a plurality of sensors arranged in a line to detect truss plates on a second side of a truss. A control circuit is configured to receive signals from the first and second sensor arrays and to notify a user when one or more truss plates are missing or misaligned.

The sensors in the first and second sensor arrays are preferably arranged directly opposite corresponding sensors in the other array. The control circuit of the truss plate detector is then preferably configured to notify a user when a sensor in the first sensor array detects a truss plate but neither a corresponding sensor nor an adjacent sensor in the second sensor array detects a truss plate. Using a plurality of laterally-arranged, oppositely located sensors, the truss plate detector can detect the presence as well as a lateral location of a truss plate on a truss being fed through the truss plate detector.

In one embodiment, the sensors of the sensor arrays are arranged in readily replaceable sensor modules. The replaceable sensor modules are located in first and second sensor array housings. One or both sensor array housing can be configured to rotate about an axis thereof to provide easy access to sensors arranged in the first sensor array. In a most preferred embodiment, the sensors are inductor sensors configured to detect changes in a magnetic field caused by an adjacent metal truss plate. The truss plate detector could also be configured to communicate with a truss press controller to stop or reverse the direction of a truss press when one or more truss plates are missing or misaligned.

A method of detecting missing or misaligned truss plates in a truss is also provided. According to this method, a truss is fed through a truss detector having a first sensor array arranged proximal to a first truss surface and a second sensor array arranged proximal to a second truss surface, opposite the first truss surface. The presence and location of truss plates on the first and second truss surfaces are detected using the first and second sensor arrays, respectively. Missing or misaligned truss plates, if any, on the opposite truss surface are then detected using the other sensor array. A user can then be notified when one or more truss plates are missing or misaligned. If no missing or misaligned plates are detected, the truss is fed through a truss press.

Detecting missing or misaligned truss plates on a truss surface can be accomplished by determining whether truss plates corresponding to the detected truss plates on an opposite truss surface are present and appropriately located on the truss surface. First and second sensor arrays arranged in proximity to a corresponding truss surface can, for instance, include a plurality of corresponding, oppositely located sensors. In such an embodiment, the user can be notified if a sensor in one of the arrays detects the presence of a truss plate and neither a corresponding sensor nor an adjacent sensor in the opposite sensor array detects a truss plate.

BRIEF DESCRIPTION OF THE DRAWINGS

The foregoing and additional objects, features, and advantages of the present invention will become more readily apparent from the following detailed description of preferred embodiments thereof, made with reference to the accompanying figures, in which.

DETAILED DESCRIPTION

Figure 1:
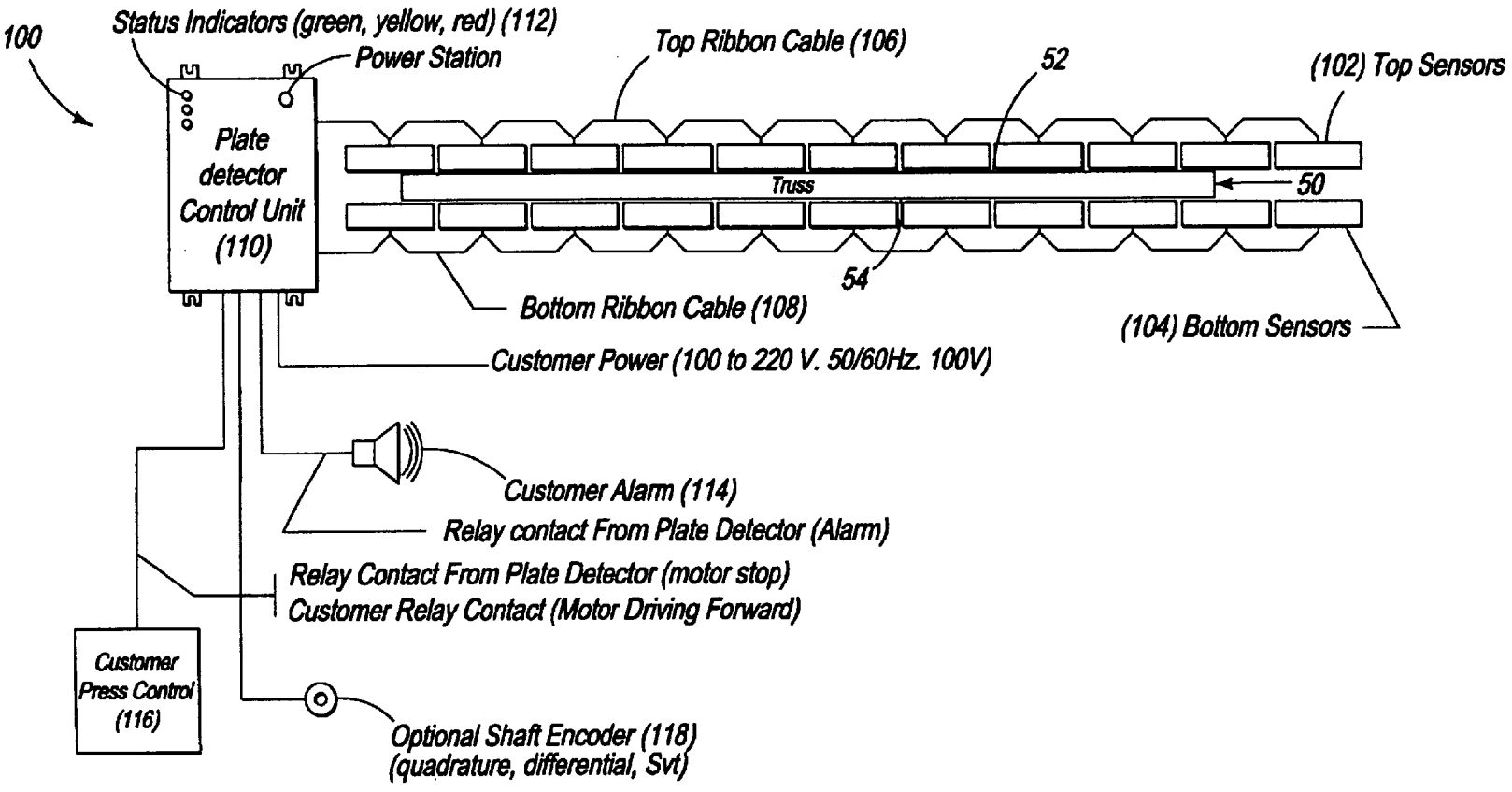
FIG. 1 is a schematic block diagram of a truss plate detector system according to a preferred embodiment of the present invention.

FIG. 1 is a schematic block diagram of a truss plate detector system 100 according to a preferred embodiment of the present invention. Referring to FIG. 1, a truss plate detector system 100 preferably includes top and bottom sensor arrays 102, 104 that communicate with a control unit 110 through corresponding ribbon cables 106, 108. The top and bottom sensor arrays 102, 104 include a plurality of corresponding, oppositely located sensors (S-T1 through S-T11 and S-B1 through S-B11, respectively).

More particularly, the truss plate detector system 100 preferably comprises a first sensor array 102 having a plurality of sensors (S-T1 to S-T11) arranged along a line to detect truss plates on a first side 52 of a truss 50. A second sensor array 104, also having a plurality of sensors (S-B1 to S-B11) arranged in a line, is configured to detect truss plates on a second side 54 of a truss 50. A control circuit (e.g., control unit 110) is configured to receive signals from the first and second sensor arrays 102, 104 and to notify a user when one or more truss plates are missing or misaligned.

The control unit 110 can be configured to receive signals from the sensor arrays 102, 104 through respective ribbon cables 106, 108. The control unit 110 is preferably configured to analyze the signals from the sensor arrays 102, 104 to determine when a truss plate on either of the truss sides 52, 54 is missing or misaligned. When a missing or misaligned truss plate is detected, the control unit 110 preferably generates an alarm condition.

Based on the alarm condition, the control unit 110 can control visual status indicators 112 and/or audible alarms 114 to notify an operator of the error. Different alarms can be generated based on whether the plate is missing or misaligned. More detailed information on the error could also be provided to a user through visible or audible indicator means, such as an LCD or other display (not shown) or voice alerts.

In operation, a truss (not shown), having truss plates arranged thereon, is fed through the truss plate detector system 100 between the two sensor arrays 102, 104. When a sensor in one of the arrays detects the presence of a truss plate, the opposite sensor array also checks for a truss plate. If neither a corresponding sensor nor an adjacent sensor in the opposite sensor array detects the presence of a truss plate within a predetermined time period, an error signal is generated. For example, if a fifth top sensor (S-T5) detects the presence of a truss plate but neither the fifth bottom sensor (S-B5) nor adjacent bottom sensors (S-B4 and S-B6) detect a truss plate within a predetermined time period, an error signal is generated and a user is notified.

The error signal can trigger an audible alarm (such as through a speaker), a visible alarm (such as through the status indicator LEDs 112), or provide any other type of user notification that an alarm condition exists. In addition, the truss plate detector system 100 can include a press control 116. The press control can be used to stop a corresponding truss press (not shown) during an alarm condition. The truss plate detector system 100 could also communicate with the press control 116 to reverse the truss press and cause it to move in the opposite direction for an appropriate distance when the error signal is generated.

Figure 2B:
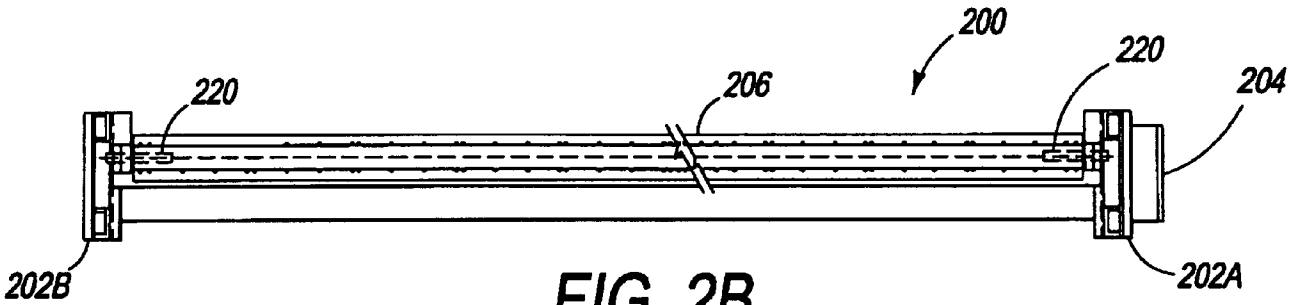
FIGS. 2A–2C are schematic plan, top, and side views, respectively, of a truss plate detector according to a more specific embodiment of inventive principles herein.
Figure 2A:
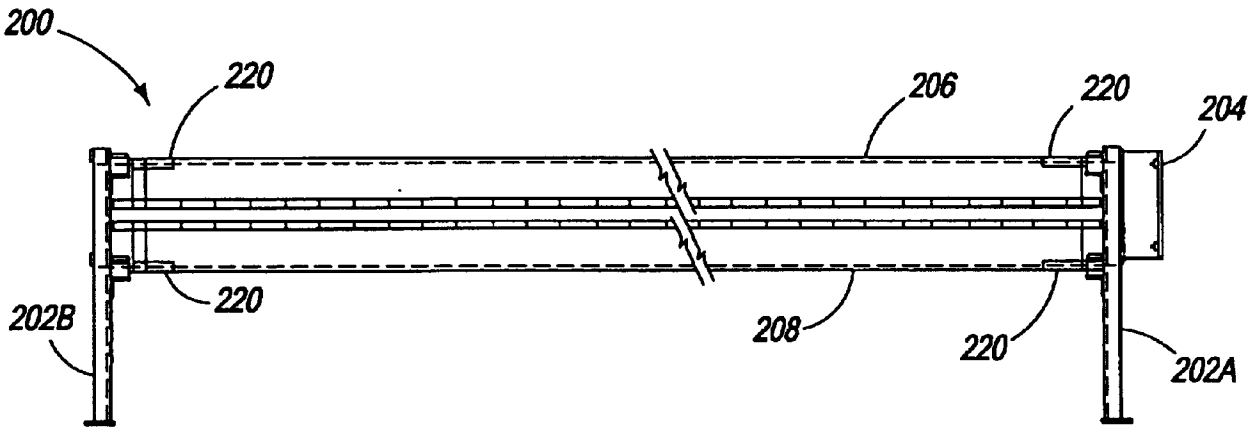
Figure 2C:
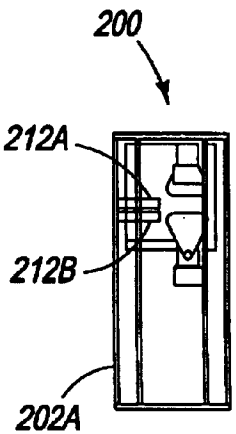

FIGS. 2A–2C are schematic plan, top, and side views, respectively, of a truss plate detector 200 according to a more specific embodiment of various inventive principles herein disclosed. Referring to FIG. 1 and FIGS. 2A through 2C, a truss plate detector 200 can include a frame having oppositely located end frames 202A, 202B. A control box 204, which houses the control unit 110, can be mounted to one of the end frames. Top and bottom sensor array housings 206, 208, which house the top and bottom sensor arrays 102, 104, respectively, can be mounted between the end frames 202A, 202B. The top and/or bottom sensor array housings 206, 208 can be further configured to rotate about a longitudinal axis thereof to provide easy access to sensors arranged in the arrays 102, 104. The opposite end frames 202A, 202B are preferably arranged to support opposite ends of the sensor array housings 206, 208. For smaller detectors, a single end frame can suffice.

A first (e.g., top) sensor array 102 is arranged in a first sensor array housing 206 and preferably includes a plurality of sensors (S-T1 to S-T11) arranged along a line to detect truss plates on a first side 52 of a truss 50. A second (e.g., bottom) sensor array 104 is arranged in a second sensor array housing 208. The second sensor array 104 also has a plurality of sensors (S-B1 to S-B11) arranged along a line. The second sensor array 104 is configured to detect truss plates on a second side 54 of a truss 50. The first and second sensor arrays 102, 104 can thereby be configured to detect the presence and lateral location of truss plates on a truss being fed through the truss plate detector. A longitudinal location of the truss plates can be determined (e.g., through a shaft encoder 118) based on an amount by which the truss has been fed through the truss plate detector. A two-dimensional location of the truss plate can thereby be determined.

The control unit 110 is configured to receive signals from the first and second sensor arrays 102, 104 and to notify a user when one or more truss plates are missing or misaligned. The truss plate detector 200, for instance, can be configured to notify a user when a sensor in one of the arrays 102, 104 detects a truss plate but neither a corresponding sensor nor an adjacent sensor in the other sensor array detects a truss plate. The truss plate detector 200 can be further configured to communicate with a press controller 116 through the control unit 110. The press controller 116 can be instructed to stop a truss press (not shown) when one or more truss plates are missing or misaligned. The truss press controller 116 could be further configured to cause the truss press to reverse directions by an amount sufficient to enable the missing or misaligned truss plate to be added or adjusted.

Top and bottom shears 212A, 212B are also preferably arranged between the end frames 202A, 202B to align the truss between the sensor arrays 102, 104 and to reduce an amount of vibration of the truss 50 as it is fed through the truss plate detector 200. The shears 212A, 212B are most preferably arranged approximately one-quarter inch from first and second truss surfaces 52, 54, and are separated from each other by about two inches overall. The first and second sensor arrays 102, 104 are preferably arranged approximately one-half inch from the first and second truss surfaces 52, 54, respectively.

Figure 3C:
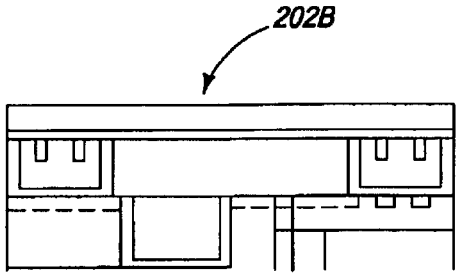
FIGS. 3A–3C are schematic plan, side, and top views respectively, of a right end frame for use in the truss plate detector of FIGS. 2A–2C.
Figure 3A:
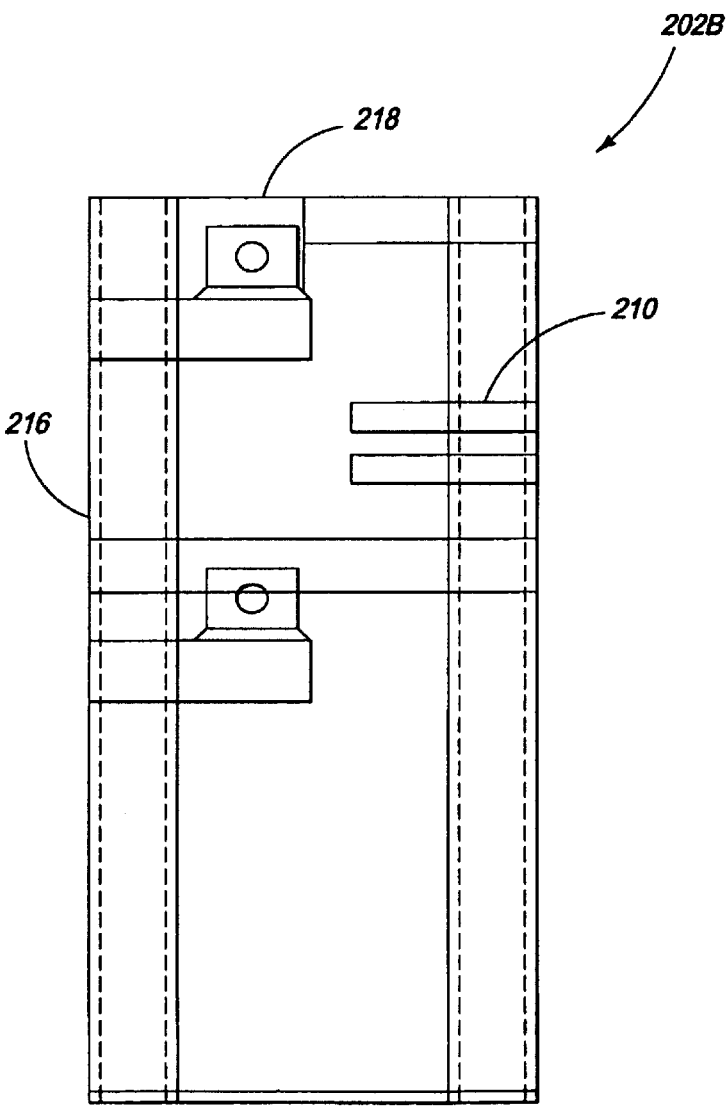
Figure 3B:
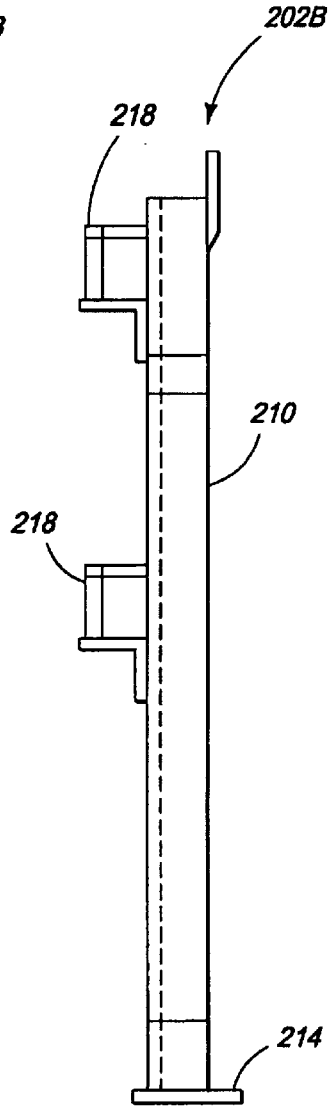
Figure 4C:
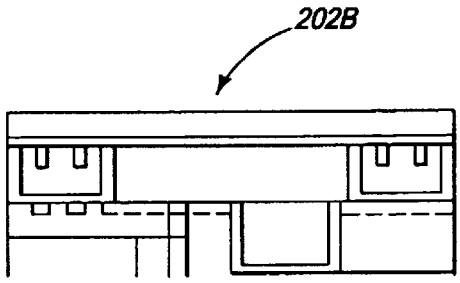
FIGS. 4A–4C are schematic plan, side, and top views, respectively, of a left end frame for use in the truss plate detector of FIGS. 2A–2C.
Figure 4B:
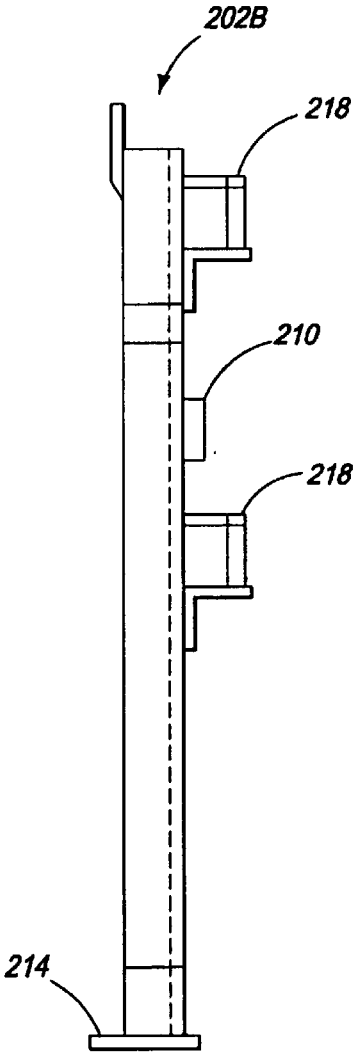
Figure 4A:
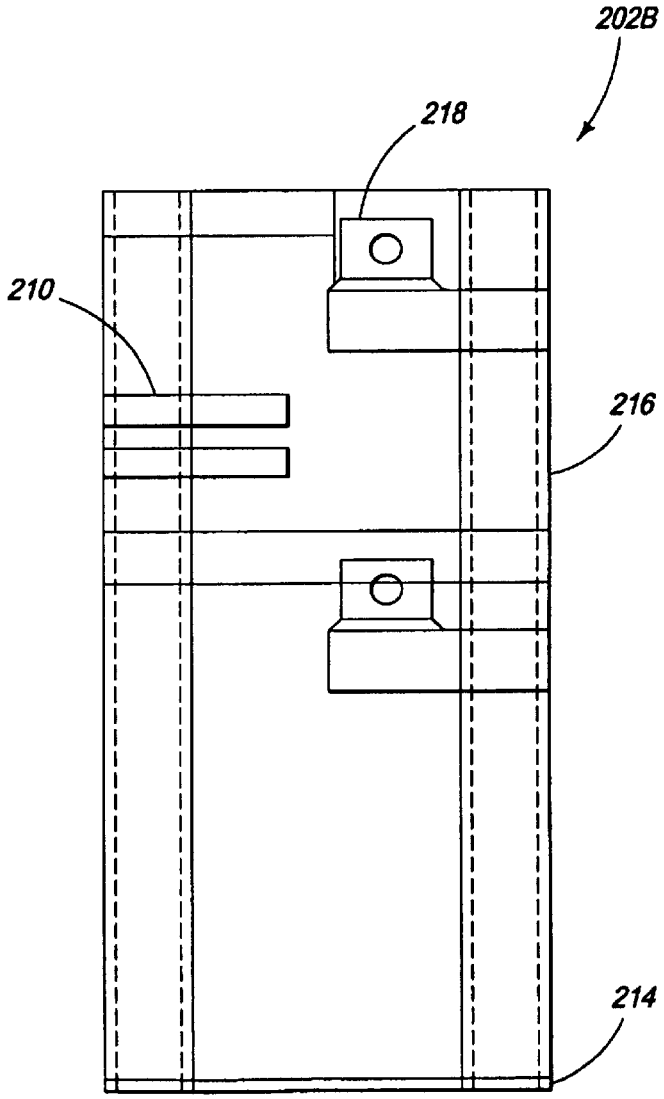

FIGS. 3A–3C are schematic plan, side, and top views, respectively, of a right end frame 202A of the truss plate detector 200 of FIGS. 2A–2C. FIGS. 4A–4C are schematic plan, side, and top views, respectively, of a left end frame 202B for use in the truss plate detector 200 of FIGS. 2A–2C. Referring to FIGS. 3A–4C, the right and left end frames 202A, 202B of this embodiment are substantially mirror images of each other. Each end frame 202A, 202B preferably comprises a vertical frame member 216 that extends vertically from a footing 214 located at a base of the vertical frame member 216. Sensor array housing support members 218 (e.g., Stauff clamps) are preferably located at an appropriate vertical distance from the footing 214. The sensor array housing support members 218 are preferably configured to receive support tubes 220 from the sensor array housings 206, 208. Although any other mechanism for attaching the sensor array housings to the vertical frame members is also acceptable, tubular members are most preferred because of their ability to carry sensor cables therein.

Shear attachment members 210 can also be provided. Shears 212A, 212B can be arranged on the attachment members 210 to more efficiently direct the truss between the sensor arrays and to reduce an amount of truss vibration. The shears 212A, 212B can be attached to the shear attachment members 210 through any appropriate physical attachment mechanism, such as bolts, welding, or other types of mechanical attachment. Although one specific shear design is described below, many alternative shear designs could also be used.

Figure 5B:
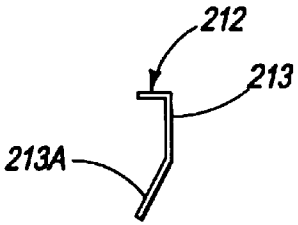
FIGS. 5A and 5B are schematic plan and side views, respectively, of a shear for use in the truss plate detector of FIGS. 2A–2C.
Figure 5A:
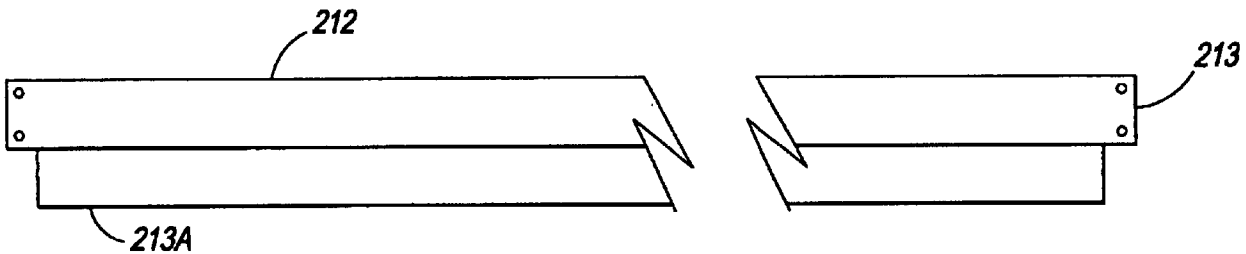

FIGS. 5A and 5B are schematic plan and side views, respectively, of a shear 212 for use in the truss plate detector of FIGS. 2A–2C. As shown in FIGS. 2A–2C, a top shear 212A and a bottom shear 212B are preferably positioned on opposite sides of a truss opening to appropriately direct the truss into the truss plate detector and reduce vibration thereof. Referring now to FIGS. 2A–2C, 5A, and 5B, each of the shears 212A, 212B preferably comprises a substantially planar member 213 that extends longitudinally across a length of the truss plate detector 200. A forward portion 213A of a top planar member is bent upwards to form a guide that will direct a truss being fed into the truss plate detector between the sensor array housings 206, 208. Similarly, a forward portion 213A of a lower planar member is bent downwards to form a guide to appropriately direct the truss between the sensor array housings 206, 208.

Figure 6A:
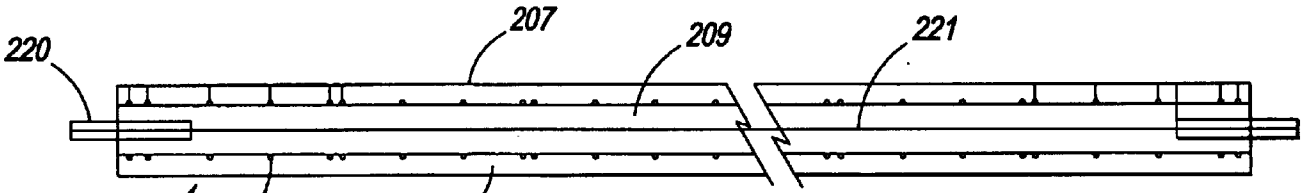
FIGS. 6A–6C are schematic bottom, side, and enlarged cross-sectional views, respectively, of a sensor array housing for the truss plate detector of FIGS. 2A–2C.
Figure 6B:
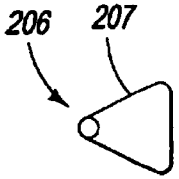
Figure 6C:
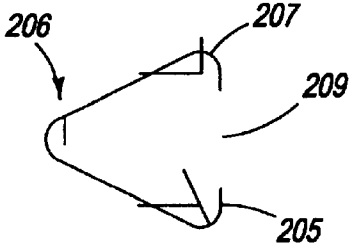

FIGS. 6A–6C are schematic bottom, side, and enlarged cross-sectional views, respectively, of a top sensor array housing 206 of the truss plate detector 200 shown in FIGS. 2A–2C. A bottom sensor array housing 208 preferably has a similar construction. Referring to FIGS. 6A–6C, the sensor array housing 206 comprises an outer wall having a substantially triangular cross-section. An opening 209 is arranged in a bottom of the outer wall 207 to receive sensor modules 300 (see FIGS. 10A and 10B). A spacer 310 (see FIGS. 7A and 7B) can also be arranged in the opening 209. Support members 220 (e.g. support tubes) are preferably arranged at opposite ends of the sensor array housing 206 to support the housing on the frame (see FIGS. 2A–2C). The support members 220 can be rods, bolts, hinges, or any other mechanical structure that attaches the housing to the frame but are preferably tubular members to carry sensor cables 106, 108 out to the control unit 110. Most preferably, the support members 220 are configured to permit rotation of the sensor array housing 206 about a longitudinal axis 221 defined through the housing 206. Rotation of the housing 206 from an operation to a maintenance position allows easy access to the sensor modules 300 for repair or replacement. A locking mechanism can be provided to maintain the housing 206 in a selected one of the operating or the maintenance positions.

In this embodiment, support tubes 220 are arranged in opposite ends of the sensor array housing 206. The support tubes 220 are retained in clamps 218 located at a proper vertical position along the vertical support members 216 of the end frames 202A, 202B (see FIGS. 2A–4C). The support tubes 220 provide the sensor housing 206 with the ability to rotate about a longitudinal axis 221 of the sensor housing 206 defined along a central longitudinal axis of the support tubes 220.

Figure 7B:
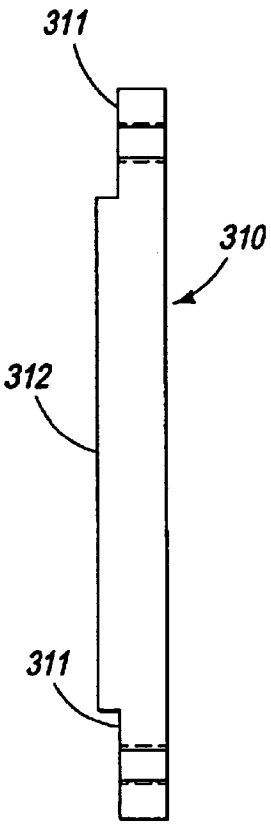
FIGS. 7A and 7B are schematic plan and side views, respectively, of a spacer for use in the sensor array housing of FIGS. 3A–3C.
Figure 7A:
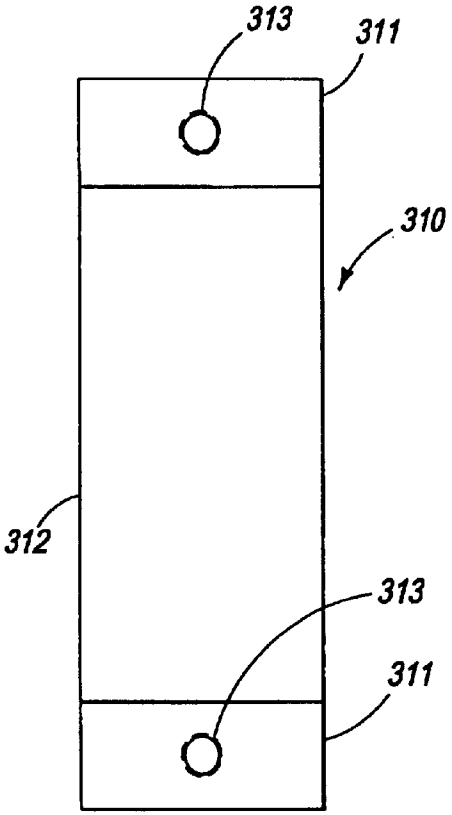

FIGS. 7A and 7B are schematic plan and side views, respectively, of a spacer 310 for use in the sensor array housing 206 of FIGS. 6A–6C. Referring to FIGS. 7A and 7B, the spacer 310 is preferably shaped to fit within the opening 209 in the housing 206 (see FIGS. 6A–6C) in order to maintain a proper spacing between opposite sides of the opening 209. The spacer 310 preferably has recessed edges 311 and a raised center 312. When positioned in the housing 206, the raised center 312 engages opposite sides of the opening 209. Through holes 313 are arranged in the recessed edges to mate with holes 205A arranged in the bottom wall 205 of the sensor array housing 206. Bolts or other appropriate mechanical connection mechanisms can then be inserted through the mating holes to secure the spacer 310 to the housing 206.

Figure 8B:
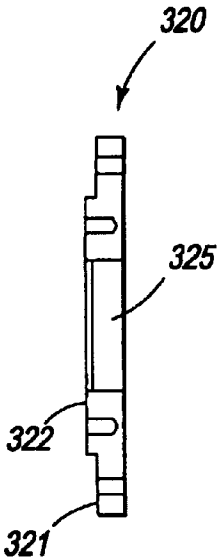
FIGS. 8A and 8B are schematic plan and side views, respectively, of a sensor plate for use in the truss plate detector of FIGS. 2A–2C.
Figure 8A:
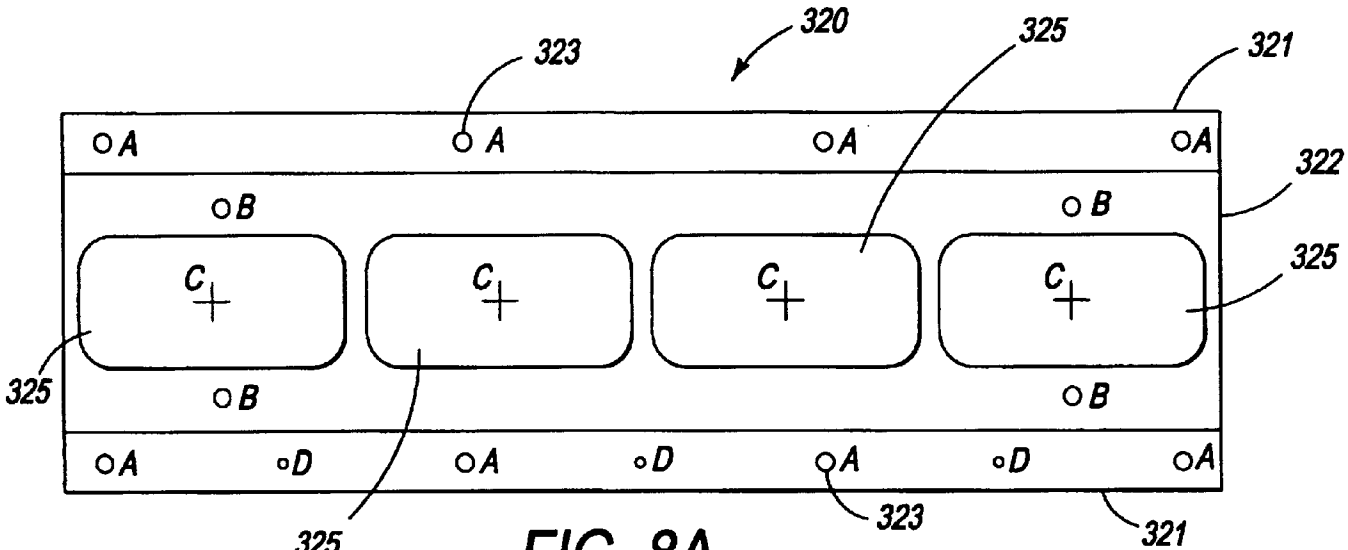

FIGS. 8A and 8B are schematic plan and side views, respectively, of a sensor plate 320 configured to hold a plurality of sensors (not shown) in the sensor array housing 206 of the truss plate detector 200 of FIGS. 2A–2C. Referring to FIGS. 8A and 8B, the sensor plate 320 has a similar construction to the spacer 310 in FIGS. 7A and 7B. More particularly, the sensor plate 320 includes a raised central portion 322 and recessed edges 321 to facilitate proper positioning of the sensor plate 320 within the opening 209 in the sensor array housing 206 (see FIGS. 6A–6C). The sensor plate 320 can also include attachment holes 323 to mate with holes 205A in the bottom wall 205 of the sensor array housing 206, to attach the sensor plate 320 to the housing 206.

Figure 9A:
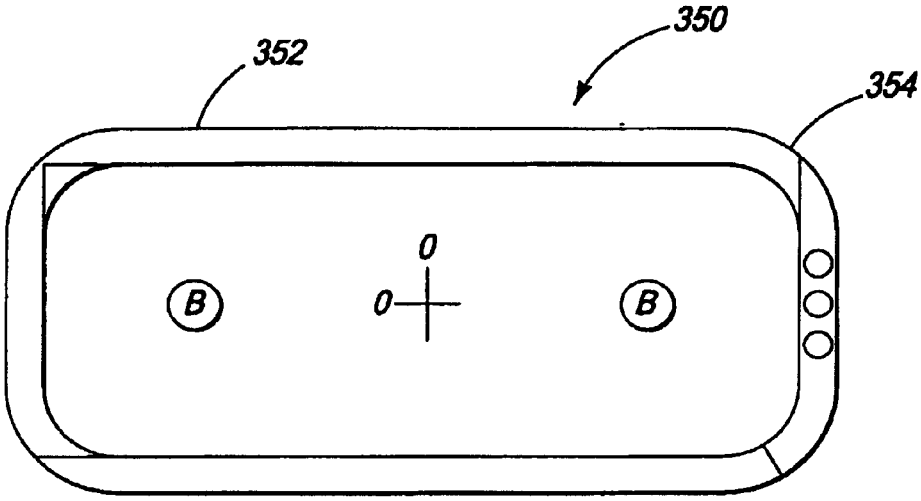
FIGS. 9A and 9B are schematic plan and side views, respectively, of a sensor for use in the truss plate detector of FIGS. 2A–2C.
Figure 9B:
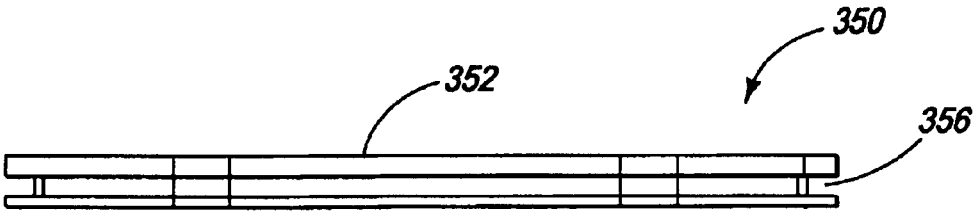

Unlike the spacer 310, however, the sensor plate 320 further includes sensor openings 325 for receiving induction sensors 350 (see FIGS. 9A and 9B). Each sensor plate 320 is preferably configured to receive a plurality of sensors 350 (four in this embodiment), but can be configured to hold a single sensor 350. The sensor plates 320, in combination with the sensors 350, form sensor modules 300 (see FIGS. 10A and 10B) that can be readily maintained or replaced as necessary in the sensor array housings 206, 208.

Each sensor 350 preferably comprises an inductor sensor configured to detect changes in a magnetic field caused by an adjacent metal truss plate. FIGS. 9A and 9B are schematic plan and side views, respectively, of a sensor 350 for use in the truss plate detector 200 of FIGS. 2A–2C. Referring to FIGS. 9A and 9B, a sensor 350, preferably an induction sensor, is configured having a substantially rectangular body 352 having rounded edges 354. The sensor 350 is preferably sized and shaped to fit within the sensor openings 325 in the sensor plate of FIGS. 8A and 8B. In a most preferred embodiment, the dimensions of the sensor are approximately three and one-half inches long by about one and three-quarters inches wide and about one-quarter inch thick.

The inductor sensors 350 are preferably configured to detect changes in a magnetic field caused by a truss plate being located in proximity thereto. As can be seen from FIG. 9B, the sensors 350 preferably include a groove 356. The groove is most preferably about one-tenth of an inch wide. Sensing wire (not shown) can be wound around the sensor 350 in the groove 356 to provide the ability to sense changes in a magnetic field.

Figure 10B:
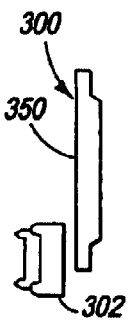
FIGS. 10A and 10B are schematic plan and side views, respectively, of a sensor array and communications elements for use in the truss plate detector of FIGS. 2A–2C.
Figure 10A:
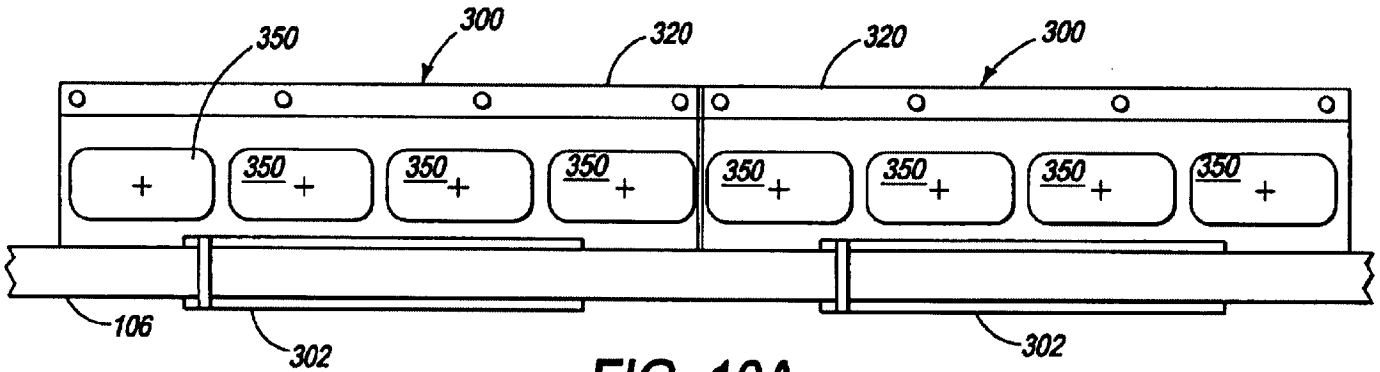

As indicated previously, the sensors in each sensor array can be arranged in readily replaceable sensor modules, with each sensor module preferably comprising two or more sensors. FIGS. 10A and 10B are schematic plan and side views, respectively, of sensor modules 300 and corresponding communications circuitry for use in the truss plate detector 200 of FIGS. 2A–2C. Referring to FIGS. 10A and 10B, a sensor module 300 includes a plurality of sensors 350 arranged in a sensor plate 320. Two modules 300 are shown in FIG. 10A. Circuit boards 302 are arranged in proximity to the each module 300, and ribbon cables 106 communicate between the circuit boards and a control unit 110 (see FIG. 1). When the sensors 350 of the first second sensor array 102 are arranged in readily replaceable sensor modules 300, corresponding sensor modules 300 are preferably arranged in the second sensor array 104, opposite to the modules 300 in the first sensor array 102.

Figure 11:
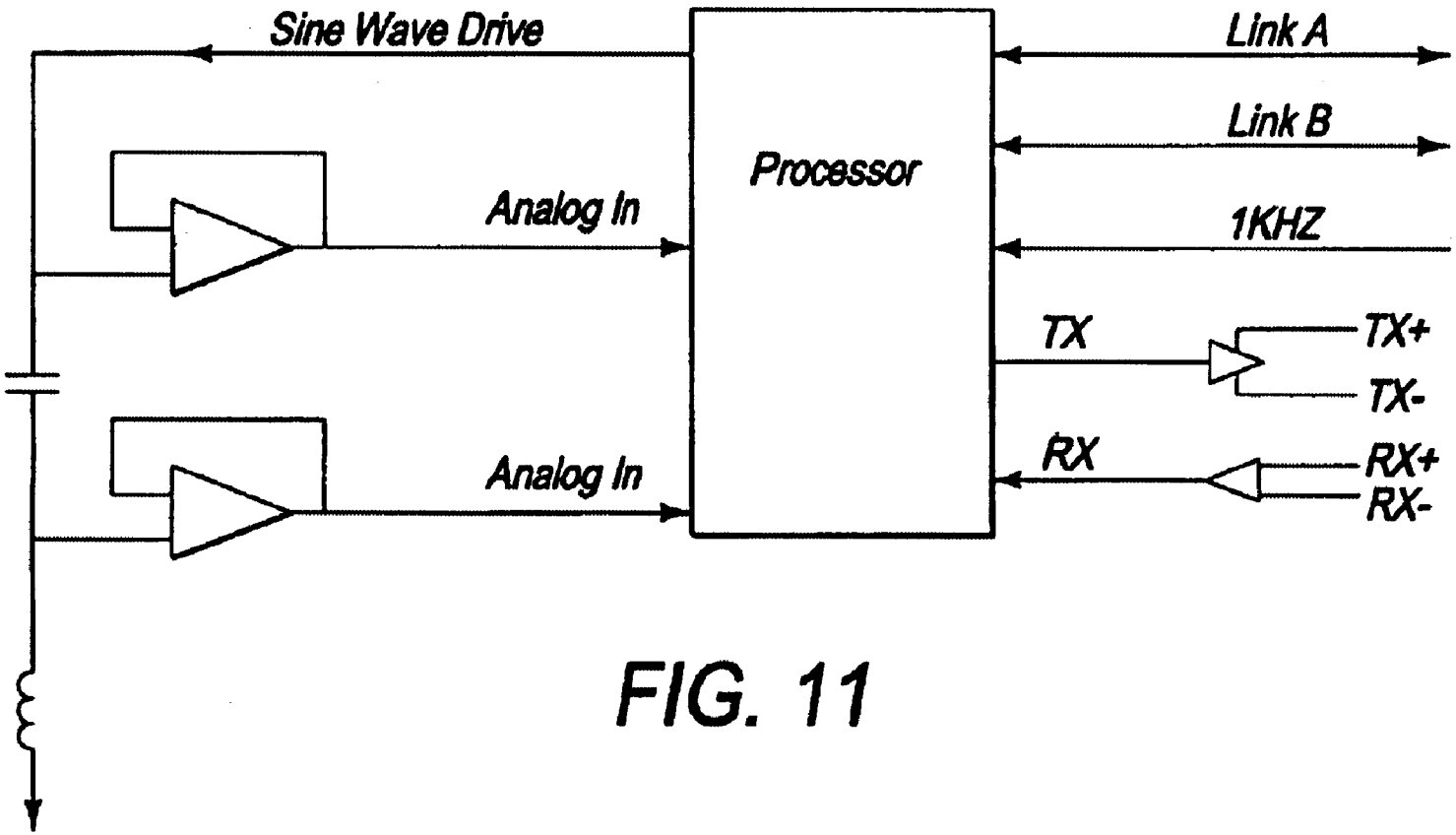
FIG. 11 is a schematic block diagram of a sensor board for use in the truss plate detector of FIG. 1.
Figure 12A:
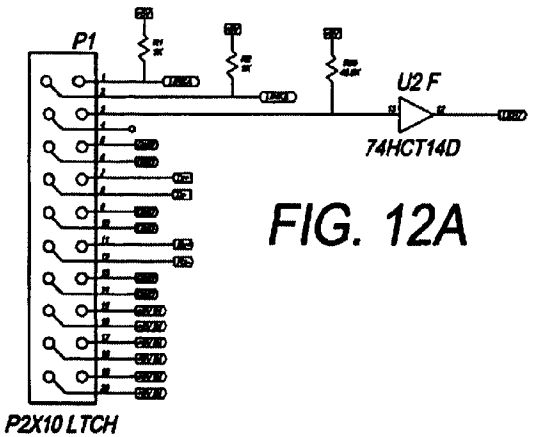
FIGS. 12A–12M are schematic circuit diagrams illustrating the circuitry of the sensor board of FIG. 11.
Figure 12B:
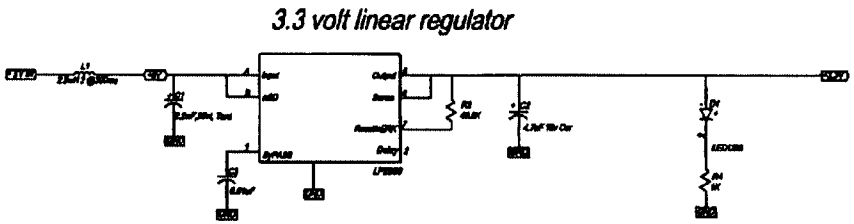
Figure 12C:
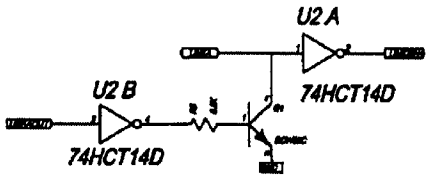
Figure 12D:
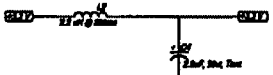
Figure 12E:
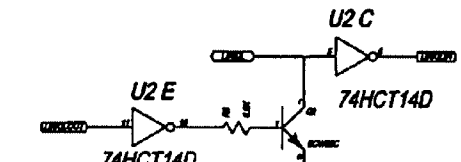
Figure 12F:
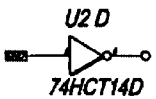
Figure 12G:
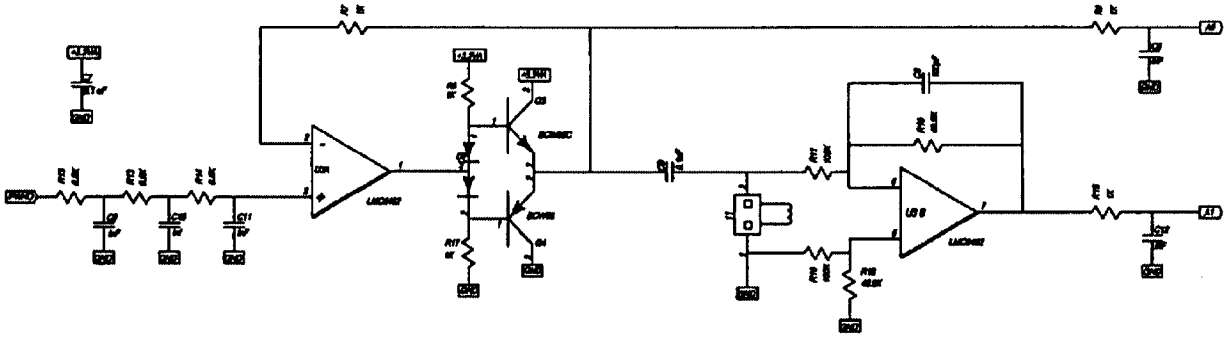
Figure 12H:
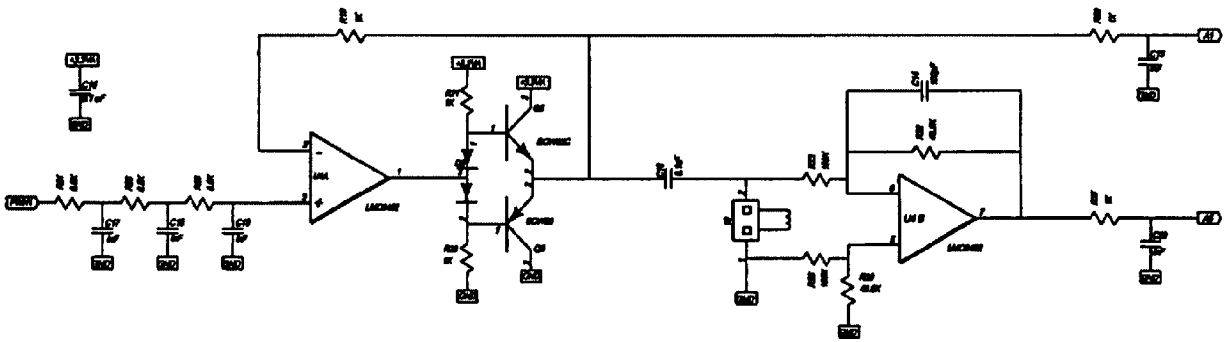
Figure 12I:
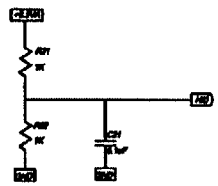
Figure 12K:
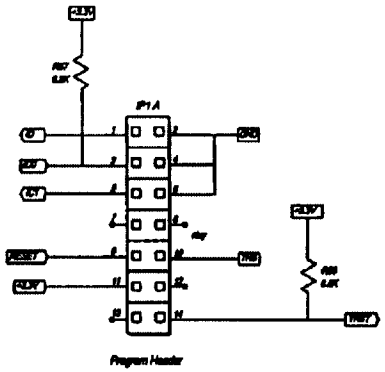
Figure 12M:
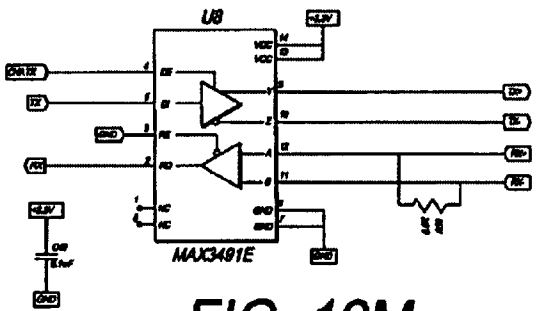
Figure 12J:
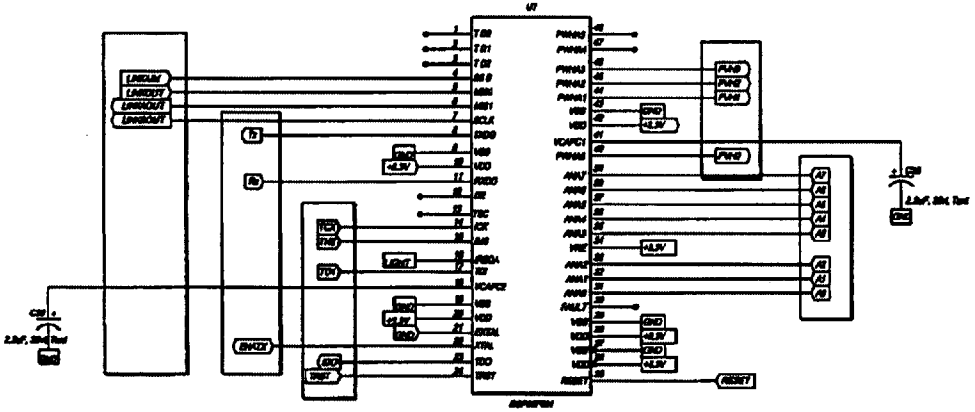
Figure 12L:
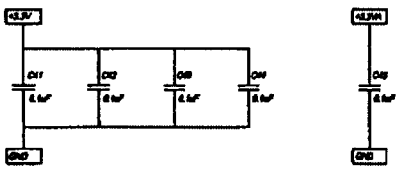

FIGS. 11, 12A through 12M, 13, and 14A through 14V provide both block and schematic circuit diagrams of various circuit elements used to generate, communicate, receive, and analyze data from the sensor arrays 102, 104 (see FIG. 1) and to generate an error signal under appropriate conditions. More specifically, FIG. 11 is a schematic block diagram of a sensor circuit for use in a sensor circuit board 302 (see FIGS. 10A and 10B) of the truss plate detector 200 of FIGS. 2A–2C. FIGS. 12A–12M are more detailed schematic circuit diagrams of the circuitry of the sensor circuit board 302 of FIG. 11.

Figure 13:
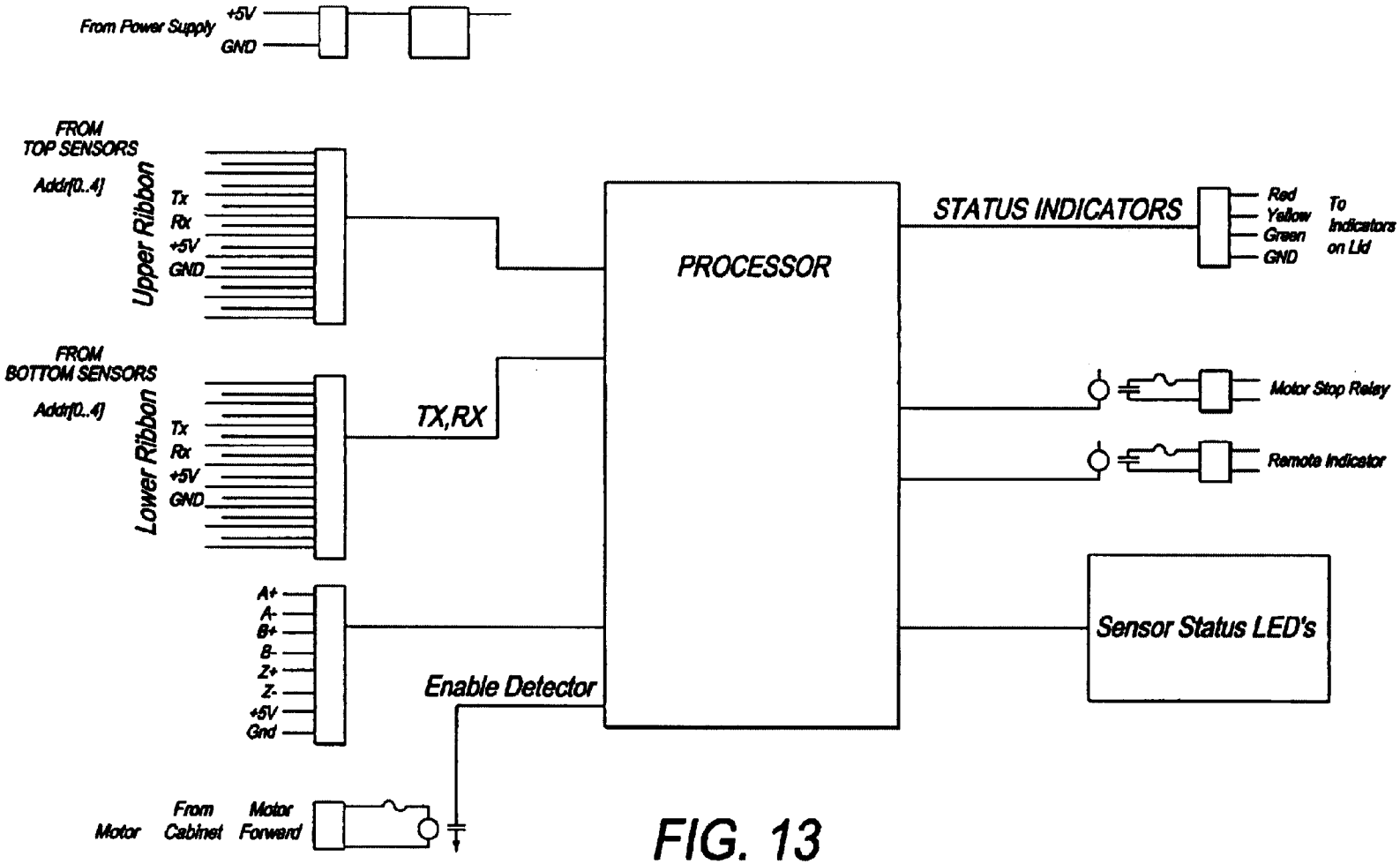
FIG. 13 is a schematic block diagram of a control board for use in the truss plate detector of FIG. 1.
Figures 14A, 14B, 14C, 14D, 14E, 14F, 14G:
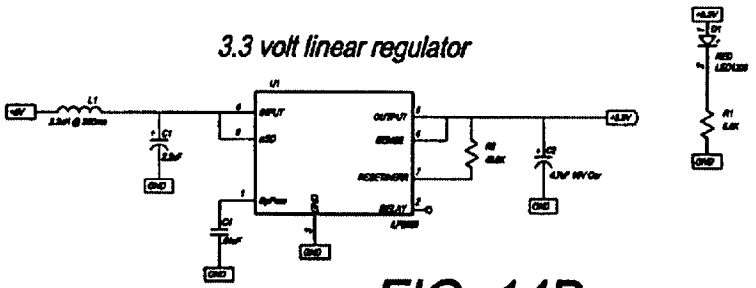
FIGS. 14A–14V are schematic circuit diagrams illustrating the circuitry of the control board of FIG. 13.
Figure 14J:
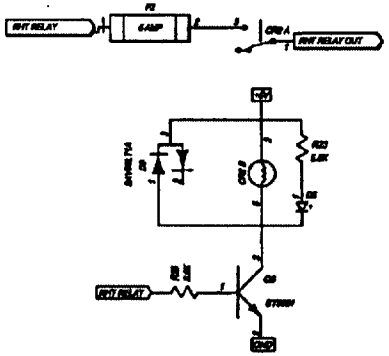
Figure 14L:
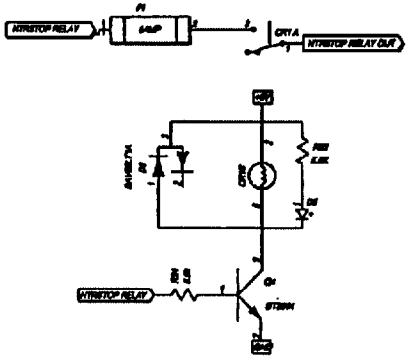
Figure 14I:
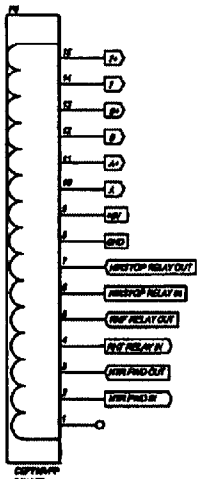
Figure 14K:
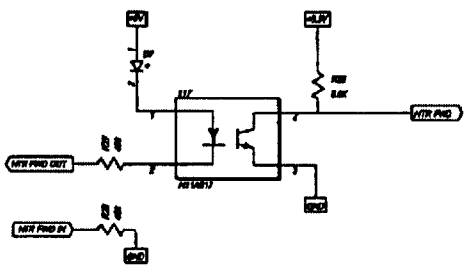
Figure 14H:
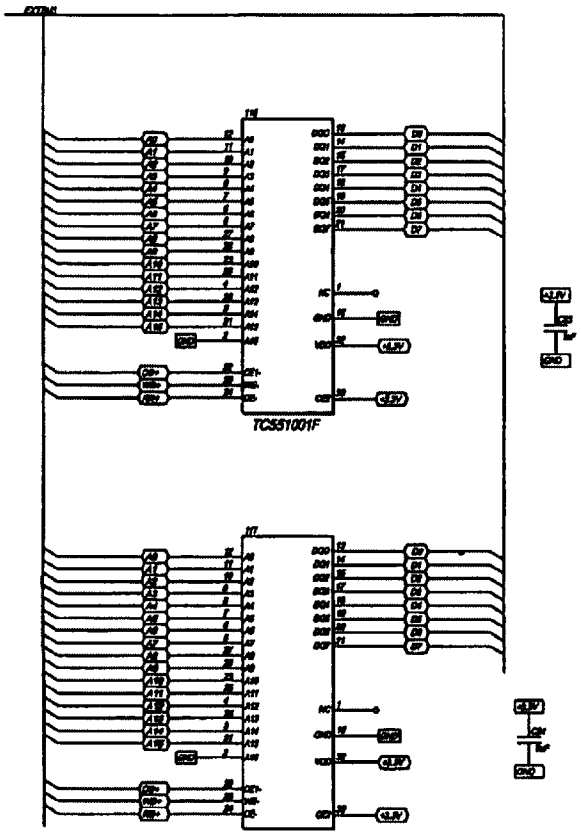
Figures 14M, 14N, 14O, 14P, 14Q, 14R, 14S:
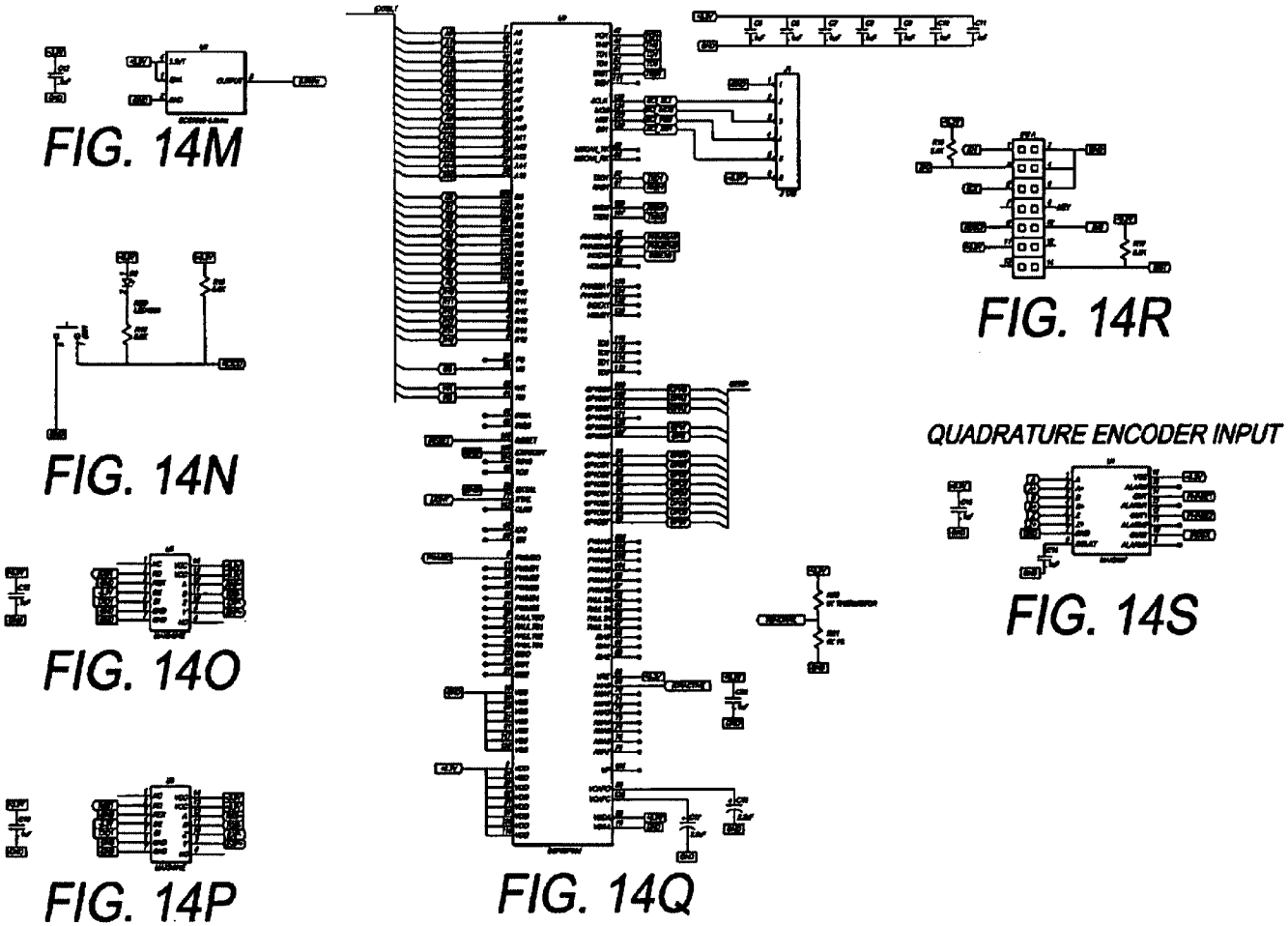
Figure 14V:
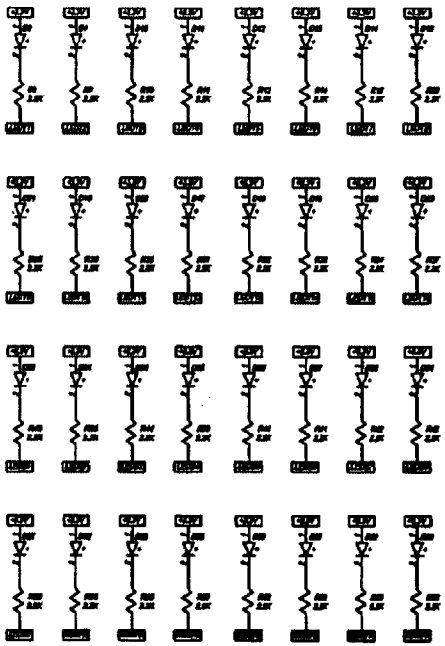
Figure 14U:
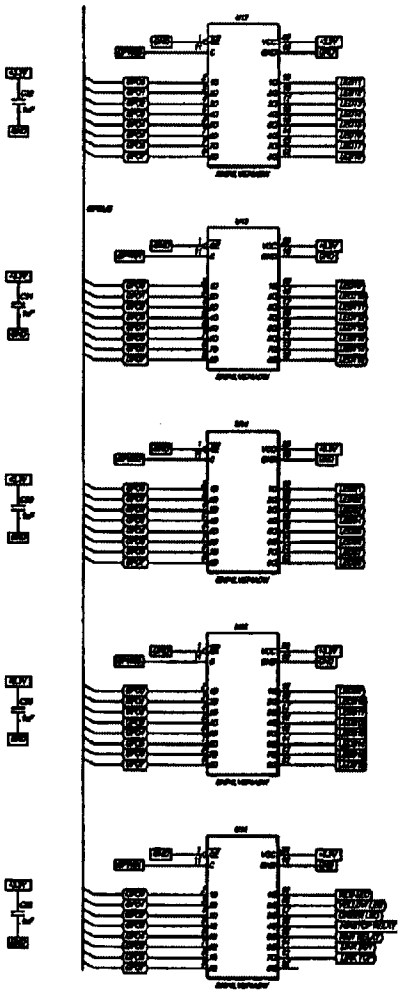
Figure 14T:
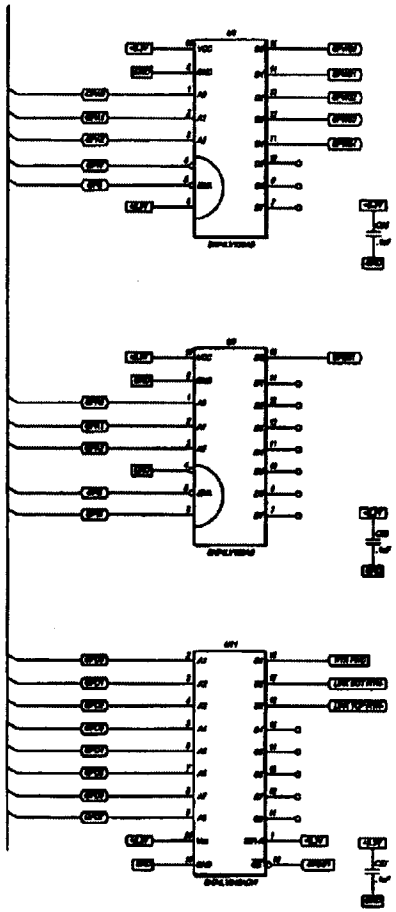

FIG. 13 is a schematic block diagram of a control circuit for use in the control unit 110 of the truss plate detector system 100 of FIG. 1. And FIGS. 14A–14V are more detailed schematic circuit diagrams of the circuitry of the control board of FIG. 13. The specific operation of these circuits will be apparent to those skilled in the art from the foregoing diagrams illustrating the construction thereof. A detailed description thereof will therefore not be provided. Various modifications to the depicted circuitry will also be apparent to those skilled in the art and all such modifications fall within the spirit and scope of this invention.

Figure 15:
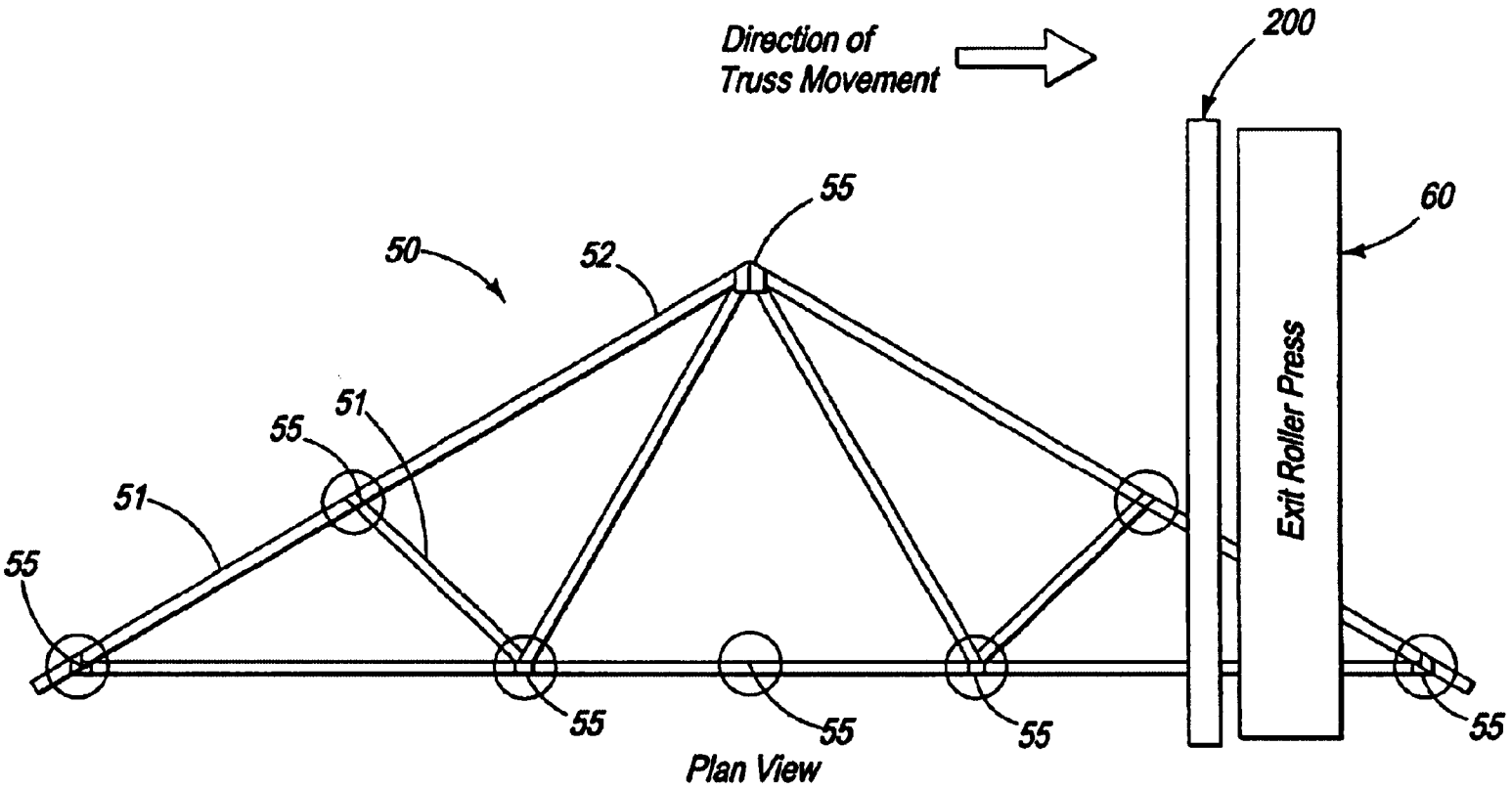
FIG. 15 is a schematic plan view of the truss plate detector of FIGS. 2A–2C arranged in operative relationship with a truss press according to one arrangement.

FIG. 15 is a schematic top plan view of the truss plate detector 200 of FIGS. 2A–2C, shown in operative relationship with a truss press 60 according to one arrangement. Referring to FIG. 15, the truss plate detector 200 is preferably arranged on an input side of the truss press 60, before the plates are pressed completely into the truss 50. In this manner, truss defects including missing or misaligned plates 55 can be detected and corrected before feeding the truss 50 through the exit roller press 60.

The truss plate detector 100 could also, however, be arranged on an output side of the truss press 60. When arranged on the output side, however, the truss plate detector 200 is unable to detect defects until after the truss 50 has already been fed through the press 60. Accordingly, when defects are found, the press 60 must either be reversed so that the error can be corrected, or the entire truss 50 must be refed through the press 60 after a plate has been appropriately positioned on the truss 50.

Referring to FIGS. 1, 2A–2C, and 15, in operation, a truss 50 includes a plurality of boards 51 attached together via truss (or nail) plates 55. The truss 50 is fed through a truss detector 200 having a first sensor array 102 arranged proximal to a first truss surface 52 and a second sensor array 104 arranged proximal to a second truss surface 54. The presence and location of truss plates 55 on the first truss surface 52 is detected using the first sensor array 102. The presence and location of truss plates 55 on the second truss surface 54 are detected using the second sensor array 104. A user is notified when one or more truss plates 55 on either truss surface are missing or misaligned. If no missing or misaligned truss plates 55 are detected, the truss 50 is fed through the press 60.

Missing or misaligned truss plates on the truss surfaces are preferably detected by determining whether truss plates corresponding to the detected truss plates on one truss surface are present and appropriately located on the opposite truss surface. The first and second sensor arrays preferably comprise a plurality of corresponding, oppositely located sensors. The user can then be notified if a sensor in one sensor array detects the presence of a truss plate and neither a corresponding sensor or an adjacent sensor in the opposite sensor array detects a truss plate. An error signal can further be communicated to a truss press when one or more truss plates on the truss surfaces are missing or misaligned. The press can then be stopped in response to the error signal.

Having described and illustrated the principles of the invention in preferred embodiments thereof, it should be apparent that the invention can be modified in arrangement and detail without departing from such principles. All such modifications and variations come within the spirit and scope of the following claims.

What is claimed is:

1. A truss plate detector, comprising:

a first sensor array having a plurality of sensors arranged along a line to detect truss plates on a first side of a truss, said first sensor array producing a first signal in response to a detected truss plate on the first side of the truss;

a second sensor array having a plurality of sensors arranged along a line to detect truss plates on a second side of a truss, said second sensor array producing a second signal in response to a detected truss plate on the second side of the truss; and a circuit receiving the first and second signals from the first and second sensor arrays and notifying a user when one or more truss plates are missing or misaligned, the circuit simultaneously comparing the first and second signals to determine whether corresponding plates are arranged on opposite sides of the truss.

2. A truss plate detector according to claim 1, wherein the sensors of the first and second sensor arrays are arranged in readily replaceable sensor modules, wherein each sensor module comprises a plurality of sensors.

3. A truss plate detector according to claim 2, wherein corresponding sensor modules in the first and second sensor arrays are arranged opposite each other across a truss opening.

4. A truss plate detector according to claim 1, wherein the truss plate detector is configured to notify a user when a sensor in one of the sensor arrays detects a truss plate but neither a corresponding sensor nor an adjacent sensor in the other sensor array detects a truss plate.

5. A truss plate detector according to claim 1, wherein the truss plate detector is configured to communicate with a truss press controller, and wherein said truss plate controller is configured to stop a truss press when one or more truss plates are missing or misaligned.

6. A truss plate detector according to claim 5, wherein the truss press controller is further configured to cause the truss press to reverse directions by an amount sufficient to enable the missing or misaligned truss plate to be added or adjusted.

7. A truss plate detector according to claim 1, wherein the first sensor array is arranged in a sensor array housing, and wherein the sensor array housing is configured to move to provide easy access to sensors arranged in the first sensor array.

8. A truss plate detector according to claim 1, wherein each sensor comprises an inductor sensor configured to detect changes in a magnetic field caused by an adjacent metal truss plate.

9. A truss plate detector according to claim 1, wherein each sensor array comprises one or more sensor modules, wherein each sensor module comprises two or more sensors, and wherein the sensors in the sensor modules in the first sensor array are arranged opposite corresponding sensors in the sensor modules in the second sensor array.

10. A method of detecting missing or misaligned truss plates in a truss, comprising:

feeding a truss through a truss detector, said truss detector having a first sensor array arranged proximal to a first truss surface and a second sensor array arranged proximal to a second truss surface;

detecting truss plates on the first truss surface using the first sensor array;

detecting missing or misaligned truss plates, if any, on the second truss surface using the second sensor array by determining whether truss plates are arranged in a corresponding location on both the first and second truss surfaces;

notifying a user when one or more truss plates on the second truss surface are missing or misaligned;

feeding the truss through a press if no missing or misaligned truss plates are detected.

11. A method according to claim 10, wherein detecting missing or misaligned truss plates on the second surface comprises determining whether truss plates corresponding to the detected truss plates on the first truss surface are present and appropriately located on the second truss surface in proximity with the truss plates on the first truss surface.

12. A method according to claim 10, wherein the first and second sensor arrays comprise a plurality of corresponding, oppositely located sensors, and wherein the user is a missing or misaligned truss plate is detected if a sensor in the first sensor array detects the presence of a truss plate and neither a corresponding sensor nor an adjacent sensor in the second sensor array detects a truss plate.

13. A method according to claim 10, further comprising communicating an error signal to a truss press when one or more truss plates on the second truss surface are missing or misaligned.

14. A method according to claim 13, further comprising configuring a controller to automatically cause the truss press to reverse directions by an amount sufficient to enable the missing or misaligned truss plate to be added or adjusted in response to the error signal.

15. A truss plate detector, comprising:

a frame comprising a vertical support member;

a first sensor array arranged in a first housing, said first housing supported in a first position by the vertical support member;

a second sensor array arranged in a second housing, said second housing supported in a second position by the support members;

a control circuit arranged to electrically communicate with the first and second sensor arrays;

wherein the first and second sensor arrays comprise a plurality of oppositely located sensors configured to detect the presence and location of truss plates on a truss being fed through the truss plate detector;

wherein the plurality of sensors are arranged in one or more sensor modules that can be readily removed from the first and second housings and replaced; and further wherein the first housing can be moved from an operating position to a maintenance position, and wherein in the maintenance position, the sensor module or modules in the first sensor array can be more easily removed and replaced.

16. A truss plate detector according to claim 15, further comprising one or more shears configured to reduce an amount of vibration of the truss being fed through the truss plate detector.

17. A truss plate detector according to claim 16, wherein the shears are each arranged approximately one-quarter inch from a respective first or second truss surface, and wherein each of the first and second sensor arrays are arranged approximately one-half inch from a respective one of the first or second truss surfaces.

18. A truss plate detector according to claim 15, wherein the plurality of sensors in each of the sensor arrays comprises a plurality of inductor sensors configured to detect changes in a magnetic field caused by a truss plate being located in proximity thereto.

19. A truss plate detector according to claim 15, wherein the control circuit determines whether one or more truss plates are missing or misaligned by detecting whether corresponding plates are arranged on opposite sides of the truss.

20. A truss plate detector according to claim 18, wherein the first housing can be rotated from an operating position to a maintenance position.

* * * * *